US011643267B2

(12) United States Patent
Gaillard et al.

(10) Patent No.: US 11,643,267 B2
(45) Date of Patent: May 9, 2023

(54) DISPENSER FOR A PRESSURIZED CONTAINER

(71) Applicant: LINDAL FRANCE (SAS), Val-de-Briey (FR)

(72) Inventors: Eric Gaillard, Dieue-sur-Meuse (FR); Hervé Bodet, Verdun (FR)

(73) Assignee: LINDAL FRANCE (SAS), Val-de-Briey (FR)

( * ) Notice: Subject to any disclaimer, the term of this patent is extended or adjusted under 35 U.S.C. 154(b) by 0 days.

(21) Appl. No.: 17/423,987

(22) PCT Filed: Jan. 21, 2020

(86) PCT No.: PCT/EP2020/051337
§ 371 (c)(1),
(2) Date: Jul. 19, 2021

(87) PCT Pub. No.: WO2020/152127
PCT Pub. Date: Jul. 30, 2020

(65) Prior Publication Data

US 2022/0081188 A1 Mar. 17, 2022

(30) Foreign Application Priority Data

Jan. 25, 2019 (FR) ..... 1900676

(51) Int. Cl.
*B65D 83/16* (2006.01)
*B65D 83/20* (2006.01)
(Continued)

(52) U.S. Cl.
CPC ..... *B65D 83/206* (2013.01); *B65D 83/205* (2013.01); *B65D 83/48* (2013.01); *B65D 83/753* (2013.01); *B65D 83/28* (2013.01)

(58) Field of Classification Search
CPC .... B65D 83/22; B65D 83/206; B65D 83/753; B65D 83/205; B65D 83/46; B65D 83/303;
(Continued)

(56) References Cited

U.S. PATENT DOCUMENTS 4,328,911 A * 5/1982 Knickerbocker .... B65D 83/206 222/182
4,416,399 A * 11/1983 Parr ..... B65D 83/228 222/402.13
(Continued)

FOREIGN PATENT DOCUMENTS

EP 3251753 A1 12/2017
FR 2429161 A1 1/1980
(Continued)

OTHER PUBLICATIONS

International Search Report and Written Opinion for the International Patent Application No. PCT/EP2020/051337, dated Apr. 17, 2020, 11 pages [translation of ISR included, 2 pages].
(Continued)

*Primary Examiner* — Charles P. Cheyney
(74) *Attorney, Agent, or Firm* — KDW Firm PLLC

(57) ABSTRACT

A dispenser for a pressurised container provided with a valve, provided with a base body having a finger tab intended to be pressed by the user in order to actuate the valve, and having an output opening intended for the output of a product contained in the container. The dispenser includes an output pipe placed in the base body, which output pipe has a first end configured to cooperate with the valve of the pressurised container, and a second end configured for the output of the product contained in the pressurised container. The output pipe is coupled to the base body so that the second end of the output pipe is substantially facing the output opening of the base body. At least one
(Continued)

part of the base body is manufactured from recycled material. The output pipe is manufactured from a material different from the recycled material.

17 Claims, 5 Drawing Sheets

(51) Int. Cl.
*B65D 83/14* (2006.01)
*B65D 83/48* (2006.01)
*B65D 83/28* (2006.01)

(58) Field of Classification Search
CPC ..... B65D 83/20; B65D 83/63; B65D 83/228; B65D 83/40
USPC ..... 222/402.11, 402.13
See application file for complete search history.

(56) References Cited

U.S. PATENT DOCUMENTS 4,815,541 A 3/1989 Arrington
7,789,278 B2 * 9/2010 Ruiz de Gopegui ..... B05B 7/2435 222/635
10,064,472 B2 9/2018 Campbell et al.
2002/0108972 A1 * 8/2002 Bayer ..... B65D 83/206 222/402.13
2003/0089734 A1 5/2003 Eberhardt et al.
2004/0245294 A1 * 12/2004 Mineau ..... B65D 83/205 222/402.13
2007/0051754 A1 3/2007 Strand et al.
2007/0290007 A1 * 12/2007 Eberhardt ..... B65D 83/206 222/402.13
2008/0164345 A1 * 7/2008 Belau ..... B65D 83/206 239/337
2008/0221561 A1 9/2008 Geiger et al.
2009/0321381 A1 12/2009 Paas et al.
2010/0147898 A1 * 6/2010 Blumenstein ..... B29C 45/1657 222/402.13
2015/0014368 A1 * 1/2015 Greiner-Perth ..... A61M 15/08 222/402.13
2015/0050425 A1 2/2015 Hanson et al.
2015/0251202 A1 * 9/2015 Ogata ..... B05B 11/0078 239/418
2016/0221744 A1 * 8/2016 Coppus ..... B65D 83/206
2017/0233171 A1 8/2017 Christianson et al.
2018/0118444 A1 * 5/2018 Bodet ..... B65D 83/22
2020/0062489 A1 * 2/2020 Spang, Jr. ..... B65D 83/206

FOREIGN PATENT DOCUMENTS

FR 2556242 A1 6/1985
FR 2881721 A1 8/2006
WO 2011111244 A1 9/2011

OTHER PUBLICATIONS

International Search Report and Written Opinion for the International Patent Application No. PCT/EP2020/051336, dated Apr. 22, 2020, 11 pages [translation of ISR included, 2 pages].
International Search Report and Written Opinion for the International Patent Application No. PCT/EP2020/051335, dated Apr. 23, 2020, 13 pages [translation of ISR included, 2 pages].

* cited by examiner

DISPENSER FOR A PRESSURIZED CONTAINER

This is a national stage application filed under 35 U.S.C. § 371 of pending international application PCT/EP2020/051337, filed Jan. 21, 2020, which claims priority to French Patent Application No. FR 1900676, filed Jan. 25, 2019, the entirety of which applications are hereby incorporated by reference herein.

FIELD OF THE INVENTION

The present invention relates to a diffuser for a pressurized container fitted with a valve, especially for an aerosol generator, and more particularly to a diffuser comprising different materials.

BACKGROUND OF THE INVENTION

Generally, a diffuser consists of two main elements having distinct functions and injected in a single material. These two elements are the outlet duct, the functions of which are to guide the product contained in the pressurized container from the valve and to dispense this product, and the base body which protects the outlet duct and which comprises elements to actuate the outlet duct for the release of the product. The diffuser can be moulded in one single piece or have injected parts in one material which are then assembled or welded together. Only the outlet duct of the diffuser is in direct contact with the product contained in the container. There are therefore some constraints on the material to be used for manufacturing the outlet duct depending on the product contained in the pressurized container. This constraint in terms of manufacturing material imposes costs on the manufacturing of the diffuser. Thus, there is a need for a base body and an outlet duct for a diffuser with optimised costs.

There are already some diffusers with elements which, before assembly, are initially separate and then put together, by bonding or thermal welding, or which are produced by co-injection moulding and whose design takes into account the base body on the one hand and the outlet duct on the other. However, the optimization variable in these diffuser elements is usually about improving the way the product contained in the pressurized container is dispensed. Little or no consideration is given to optimizing the amount of material used to manufacture the outlet duct, whose cost is generally linked to the chosen material. Therefore, it is necessary to have a diffuser whose outlet duct and base body can optimize the grades and amounts of chosen materials in order to limit additional costs. Moreover, in order to observe societal commitments whilst complying with regulations, it may be important and indeed essential to be able to select different material grades for the outlet duct and the base body.

DISCLOSURE OF THE INVENTION

The purpose of the invention is to provide a diffuser in which the choice of material respectively used for the outlet duct and the base body is only dictated by their desired respective properties; this diffuser should also be more economical to manufacture.

According to the first aspect of the invention, there is provided a diffuser for a pressurized container fitted with a valve, especially for an aerosol generator. The diffuser is provided with a base body having a finger tab to be depressed by the user to actuate the valve, and having an outlet opening for the release of a product contained in the pressurized container. The diffuser is further provided with an outlet duct placed in the base body, which outlet duct has a first end configured to cooperate with the valve of the pressurized container, and a second end configured for the release of the product contained in the pressurized container. The outlet duct is coupled to the base body in such a way that the second end of the outlet duct is substantially facing the outlet opening of the base body. At least a part of the base body is manufactured from recycled material. The outlet duct is manufactured from a material different from the recycled material. Optionally, the material used for the outlet duct may also be recycled.

The embodiments of the invention are based inter alia on the inventive idea that the material used for the part of the base body and the material used for the outlet duct have different origins, and therefore different prices. Use of a material of higher grade in contact with the product contained in the pressurized container can thus be limited to the outlet duct, which is a relatively small part, whereas the material used for the part of the base body can be a recycled material selected for its mechanical characteristics, cheaper cost, aesthetics, etc., rather than for its physicochemical suitability for the product contained in the container. This goal can be reached by providing an outlet duct and a base body as two distinct parts which may be coupled using different fastening means. The dimensions of the outlet duct may thus be optimized to use as little material as possible, whilst the material used for the part of the base body is a recycled, economically advantageous material.

In the context of the invention, the adjective "recycled" refers to a material from a used object which is recovered and reintroduced into a production cycle. In other words, a recycled object is a waste product resulting from previous use and subjected to a recycling process so as to be reintroduced into a production cycle. The recycling process in question may comprise mechanical, physical and/or chemical steps or processes with a view to restoring the object's ability to be reintroduced onto the consumption market. In other words, recycling an object is a treatment process of this object's materials through which materials of a similar or non-similar object having reached the end of its life, or residual manufacturing materials, may be reintroduced into a production cycle. Depending on the quality of the recycling process, impurities may remain within the recycled material.

In the context of the invention, the phrase "physicochemical suitability" refers to a material whose chemical properties are suitable for the product contained in the pressurized container, that is to say whose physicochemical properties do not negatively affect the product's chemical composition or its organoleptic properties, and therefore its quality.

According to the embodiments of the invention, the material used for the outlet duct is different from the recycled material used for the part of the base body. In other words, the material used for the outlet duct and the material used for the part of the base body may be of different compositions. The term "composition" is intended to mean "chemical composition" in the context of the invention. For example, due to the possible presence of impurities in the recycled material, as aforementioned, the recycled material used for the part of the base body is of a different composition from that of the material used for the outlet duct.

It is thus possible to use two materials of different compositions for the outlet duct and for the base body. The material used for the outlet duct should be chemically suitable for the product to be withdrawn, whilst the recycled material of the base body does not need to satisfy this condition, but can be selected more specifically for its mechanical properties. The base body and the outlet duct may thus be manufactured in different facilities. One kind of outlet duct may be used with base bodies of different qualities, and one kind of base body may be used with outlet ducts made of different materials. Numerous combinations are therefore possible.

According to a preferred embodiment, the material used for the part of the base body has a total rate of constituent migration from said material into a reference product that is greater than the total rate of constituent migration from the material used for the outlet duct into the reference product. According to an exemplary embodiment, the total rate of migration of the constituents of the material used for the outlet duct into the reference product is less than 10 mg of said constituents per 1 $dm^2$ of surface area of said material.

According to a preferred embodiment, the material used for the outlet duct is a virgin material. According to an exemplary embodiment, the material used for the outlet duct is a material suitable for food contact.

Within the European Union, Regulation (EC) No 1935/2004, and more recently Regulation (EC) No 10/2011 on plastic materials, constitutes the basic legislation on materials intended to come into contact with food. According to the Regulation, it is stipulated that said materials must be safe for human health and must not modify the properties of the product in an unacceptable manner. The Regulation also establishes that the European Food Safety Authority (EFSA) is required to set up a conventional assessment of any risk to human health linked to the use of certain types of materials in contact with food products. Thus, the opinion rendered by EFSA must include the name of the substance under evaluation, and any specification or recommendation for any condition or restriction on the use of said substance.

It is possible to manufacture materials, especially plastic materials, so that they do not release more than 10 mg of substances per 1 $dm^2$ of surface area of said materials. A surface area of 6 $dm^2$ represents the surface area of a 1 kg (or 1 litre) cube of food. A total migration limit of 60 mg/kg applies for all materials in contact with the food. In other words, any migration of chemical constituents from said materials to food products above this limit is not allowed. If the risk assessment of an individual substance of said materials does not indicate a lower level, this level will constitute a generic limit for the inertness of a material, as described in Regulations (EC) No 1935/2004 and (EC) No 10/2011, that is to say the total migration limit of constituents from the material to the food product. Moreover, based on a toxicological risk assessment, a specific migration limit can be established in addition to the total migration limit. The specific migration limit corresponds to the maximum allowable quantity of a given substance released from a material in a food product.

To quantify the chemical transfer of constituents from a material to a food product, the concentration of migrating constituents is measured in products imitating food, also called reference products, and not in food products themselves. The use of reference products imitating real food products is an approximation for the actual migration into real food products. It is generally agreed that their use overestimates the actual migration. The reference products are used as food substitutes in order to simplify the chemical analysis of the migrating constituents found within them. The chemical detection and quantification of constituents require specific analytical methods for each chemical substance of interest, which are specially developed for each type of reference product. The reference products vary according to their chemical properties, thus representing different types of food products: hydrophilic (water-based foods), lipophilic (fatty foods) or amphiphilic (foods with both aqueous and fatty properties). For example, migration to an oily food product is measured using vegetable oil as a reference product. Reference products made of 10% ethanol or 3% acetic acid are used for water-based foods and beverages. Dry foods are simulated by a synthetic polymer with a defined porosity. Butter and other amphiphilic foods are simulated by a solution of 50% ethanol. Distilled water is commonly used as a reference product for the assessment of the total migration of constituents from a material to a food product, i.e. the total chemical transfer of the constituents from the material to the food product, without necessarily knowing and distinguishing the chemical identity of each constituent taken separately, although other reference products can be used.

It is clear to those skilled in the art that reference products can also be used to imitate products other than food products, such as cosmetic or medical products. Thus, the total rate of migration or the specific rate of migration of constituents from a material to a cosmetic or medical product can be assessed using cosmetic or medical reference products. Thus, the embodiments of the invention are not limited to the use of reference products imitating food products.

In the context of the invention, the adjective "inert" refers to a material with a total rate of constituent migration into a given product or a given reference product which is no greater than a certain safety limit, for example greater than the aforementioned total migration limit of 60 mg/kg. In other words, this represents a material that will not negatively affect, or only in a negligible way, the chemical composition of the product, and therefore its quality.

It should be noted that the adjectives "recycled" and "inert" are not necessarily mutually exclusive in the context of the invention. Thus, a recycled material can also be an inert material. However, the costs of producing an inert material are generally higher than the costs of producing a recycled material because the quality of the inert material will generally be higher than the quality of the recycled material. Indeed, impurities may remain within the recycled material, depending on the quality of the recycling process carried out. Depending on their nature, these impurities may have as a consequence that the recycled material cannot be said to be an inert material towards the product because they may have a rate of migration of constituents to the product greater than a certain safety limit, and thus negatively affect its quality.

In the context of the invention, the adjective "virgin" as opposed to the adjective "recycled" refers to a material that has not yet been used. Thus, the material of the outlet duct may be a first-use material. It should be noted that an inert material may not be virgin. In other words, a recycled material used for the outlet duct can be used if it exhibits a constituent migration rate below a certain safety limit, thus ensuring that the quality of said product is maintained. In this sense, the material is not virgin because it is not a first-use material. It should also be noted that an inert material can also be a virgin material. Thus, a distinction should be made between the adjectives "virgin" and "inert" in the context of the invention. For example, a virgin material may not be inert, and vice versa.

In the context of the invention, the phrase "suitable for food contact" refers to a material which does not negatively affect the nutritional or organoleptic quality of a food product contained in the pressurized container, thus ensuring that it is safe for consumption. It should be noted that a virgin material may also be suitable for food contact. It should also be noted that a material suitable for food contact may not be a virgin material. Thus, a distinction should be made between the adjective "virgin" and the phrase "suitable for food contact" in the context of the invention. For example, a virgin material may not be suitable for food contact, and vice versa. Thus, if the diffuser is intended for a food product, the material of the outlet duct will have to be suitable for food contact, while the recycled material of the base body will not need to be and may thus be more economical.

In other words, the suitability of an object for food contact means that the material it is made of complies with prescriptive or regulatory requirements (see European Regulations above) guaranteeing that this object poses no risk of toxicity for food or drinks Good hygiene practices require that this type of article should be inert towards food products, avoiding or safely limiting any migration of substances, and should present no catalytic effect liable to modify the quality of the food product.

It should be noted that the product contained in the pressurized container may belong to fields other than food, such as the cosmetics field or medical field. Regulations specific to these areas also exist and constitute the basic legislation which applies to materials in contact with cosmetic or medical products The base body forms a cavity which may comprise a concave wall and a convex wall forming a recess in the cavity. In the context of the invention, the adjectives "concave" and "convex" refer to the inside of the base body. In other words, these adjectives refer to an observer situated in the cavity of the base body. The outlet opening may be created in the base body's convex wall. Pressurized containers generally have a cylindrical end on which the base body will be fixed. The main body of the valve and the cylindrical end of the pressurized container may be aligned along an axis. Due to the presence of the convex wall, the outlet opening made in the convex wall may be brought closer to the valve axis, and the longitudinal dimension of the outlet duct may be minimized. As a result of the outlet opening being brought closer, the longitudinal dimension between the valve axis and the second end may be minimized, making the outlet duct more compact, thus minimizing the quantity of material used and consequently, production costs.

The finger tab of a diffuser can be defined as the part of the diffuser directly subjected to a movement following pressure of a user's finger on a portion of the outer surface of the finger tab.

The movement of the finger tab causes, generally mechanically, the movement of the outlet duct and the actuation of the valve of the pressurized container.

According to the first aspect of the invention, at least a part of the base body is manufactured from recycled material. According to an exemplary embodiment, the finger tab may be manufactured from the recycled material, or the convex wall may be manufactured from the recycled material, or the concave wall may be manufactured from the recycled material, or a combination of two of those three parts may further be manufactured from the recycled material. According to another exemplary embodiment, the entire base body may be manufactured from the recycled material. For example, the finger tab, the convex wall and the concave wall of the base body may all be produced from the recycled material.

The concave wall and the convex wall may be moulded in one single piece. The manufacturing material of the concave wall and the manufacturing material of the convex wall may thus be identical. In other embodiments, the convex wall may be assembled with the concave wall by bonding or thermal welding, or is produced by co-injection moulding. The manufacturing material of the concave wall and the manufacturing material of the convex wall may thus be different. It is preferred to produce the concave wall and convex wall as a single moulded piece as the finished part shows better mechanical strength.

According to a typical embodiment, the outlet duct could be available in a small number of so-called standard variants, for example one variant with a nozzle, and one variant without a nozzle, and the various base body designs could be made adaptable to fit the standard outlet ducts.

According to a preferred embodiment, the material used for the outlet duct comprises any one of the following materials: a polymeric material, a metal, or a combination of said aforementioned materials.

According to an exemplary embodiment, the polymeric material comprises any one of the following polymers: polyethylene (PE), polypropylene (PP), polyoxymethylene (POM), butylene polyterephthalate (PBT), polyamide (PA), or a combination of said aforementioned polymers.

According to another exemplary embodiment, the metal comprises aluminium, steel, especially stainless steel, or an alloy of the two aforementioned metals.

According to a preferred embodiment, the material used for the part of the base body comprises any one of the following materials: a polymeric material, a non-polymeric material, or a combination of said aforementioned materials.

According to an exemplary embodiment, the polymeric material comprises any one of the following polymers: polyethylene (PE), polypropylene (PP), polylactic acid (PLA), polyhydroxyalkanoate (PHA), polybutylene succinate (PBS), or a combination of said aforementioned polymers.

According to an advantageous embodiment, the base body is provided with a connecting hole in the finger tab, in such a way that the outlet duct may be fastened to the base body.

The permanent presence of a connecting hole in one part of the base body design offers an ongoing means of attaching the outlet duct to the base body for all diffuser variations. The connecting hole serves to facilitate the attaching of the outlet duct to the base body. For example, it can be used to introduce a means of attachment which may be mechanical, glue or adhesive, welding, or a tool to allow the outlet duct to be fixed to the base body. As just one connecting hole is required at a given position on the base body, the design flexibility between different diffuser variations is ensured.

In this manner, the base body and the outlet duct of the diffuser can be manufactured independently of each other in mechanically and/or chemically compatible or incompatible materials. According to an exemplary embodiment, the outlet duct may be available as standard, ready-made variants. All that is therefore required is to design one single element of the diffuser, the base body, accordingly, in such a way as to give logistical flexibility and reduce costs. The outlet duct can be fastened to the base body using a fastening portion of the outlet duct inserted into the connecting hole in such a way that it cannot come loose on its own. The inserted portion can be mechanically joined, welded, chemically bonded and/or heat-bonded to the base body. The connecting hole thus facilitates the attachment of the outlet duct and, by the insertion of the outlet duct portion, facilitates the positioning of the outlet duct in relation to the base body.

Depending on the fastening means used for attaching the outlet duct to the base body, the material used for the base body and the material used for the outlet duct may be chosen to be mechanically and/or chemically compatible with each other or not. Thus, if said inserted portion is mechanically joined to the base body, the material used for the base body and the material used for the outlet duct may be chosen to be mechanically compatible with each other, but not necessarily chemically compatible with each other. Alternatively, if said inserted portion is welded, chemically bonded and/or heat-bonded to the base body, the material used for the base body and the material used for the outlet duct may be chosen to be chemically compatible with each other, but not necessarily mechanically compatible with each other.

In the context of the invention, the phrase "chemically compatible" refers to a material whose chemical properties, especially chemical reactivity, are compatible with the chemical properties, especially chemical reactivity, of another material, that is to say whose chemical properties do not negatively affect the chemical properties of that other material.

In the context of the invention, the phrase "mechanically compatible" refers to a material whose physical properties, especially mechanical ones, are compatible with the physical properties, especially mechanical ones, of another material, that is to say whose physical properties do not negatively affect the physical properties of that other material.

Thus, a recycled polymeric material of the base body may be mechanically and/or chemically compatible with a polymeric material or a metal of the outlet duct. For example, recycled polypropylene (PP) used for manufacturing at least a part of the base body may be mechanically and/or chemically compatible with polyethylene (PE), polypropylene (PP) or aluminium used for manufacturing the outlet duct. Similarly, a non-recycled polymeric material of the base body may be mechanically and/or chemically compatible with a polymeric material or a metal of the outlet duct. For example, a recycled polymeric material used for manufacturing at least a part of the base body may be mechanically and/or chemically compatible with polyoxymethylene (POM), butylene polyterephthalate (PBT), or (stainless) steel used for manufacturing the outlet duct.

According to an advantageous embodiment, a minimum longitudinal distance between a first point, said first point being a point of the connecting hole on the external surface of the finger tab, and a second point, said second point being a point of the outlet opening on the external surface of the base body, is less than 12 mm, preferably less than 10 mm, more preferably less than 8 mm.

In this way, an additional constraint is added to the design of the base body which ensures the outlet duct used has reduced dimensions, and thus the amount of material used is economically advantageous. For example, due to the presence of said convex wall, the outlet opening made in the convex wall may be brought closer to the valve axis, and the longitudinal dimension of the outlet duct may be minimized.

According to an advantageous embodiment, the second end of the outlet duct is floating in relation to the outlet opening.

In this way, fewer connecting elements are needed between the outlet duct and the base body, which means less material is required, therefore reducing production costs.

According to an exemplary embodiment, the base body comprises a lower edge and an upper edge.

According to a preferred embodiment, the base body comprises a lower part. Said lower part of the base body forms a substantially cylindrical lower cavity and is delimited by the lower edge of the base body and a lower end of the convex wall.

According to an exemplary embodiment, a height of said lower cavity of the base body is between 15 mm and 25 mm. The height of the lower cavity of the base body is defined in a direction parallel to the valve axis, from the lower edge of the base body to the lower end of the convex wall.

In addition to said lower cavity of the base body, an upper cavity may be defined in the base body, which is formed by an upper part of the base body. Said upper cavity is delimited by the lower end of the convex wall and the upper edge of the base body.

According to an exemplary embodiment, a height of said upper cavity of the base body is between 15 mm and 35 mm. The height of the upper cavity of the base body is defined in a direction parallel to the valve axis, from the lower end of the convex wall to the top of the upper edge of the base body.

According to a preferred embodiment, the outlet duct is substantially entirely arranged within the upper cavity of the base body. In other words, the outlet duct preferably does not extend beyond the limits defined for the upper cavity of the base body.

According to an exemplary embodiment, the outlet duct is divided between a substantially straight first section and a second section which is at an angle to the first. The first section starts at the first end and ends at the junction with the second section. The second section starts at the junction with the first section and ends at the second end. The first section is preferably substantially parallel to the valve axis.

According to a preferred embodiment, a fastening portion of the outlet duct, in a fastened state, is visible from the outside of the diffuser, preferably at the finger tab, and has a recognisable shape and/or colour serving as a means of identification for the user.

Thus, the fastening portion has the dual function of identification and fastening means. The shape and/or colour of the fastening portion may indicate a type of product, the origin of the product, usage precautions for the product, a conditioning of the product, etc. As the material used for the base body is a recycled material, it would be possible, for example, to give a green colour to the outlet duct so that the fastening portion forms a green pad on the finger tab. Manufacturers would thus be able to communicate to their customers on their strategic desire to commit to a sustainable development policy.

According to a second aspect of the invention, there is provided a base body for use in a diffuser according to any one of the preceding embodiments.

According to a third aspect of the invention, there is provided an outlet duct for use in a diffuser according to any one of the preceding embodiments.

According to a fourth aspect of the invention, there is provided a use of a diffuser for a pressurized container according to any one of the preceding embodiments for dispensing food, cosmetic or medical products.

BRIEF DESCRIPTION OF THE FIGURES

These and other aspects of the present invention will now be described in more detail, with reference to the attached drawings which show examples of embodiments of the invention. Identical numbers refer to identical features in all the drawings.

DETAILED DESCRIPTION OF THE INVENTION

Figure 1A:
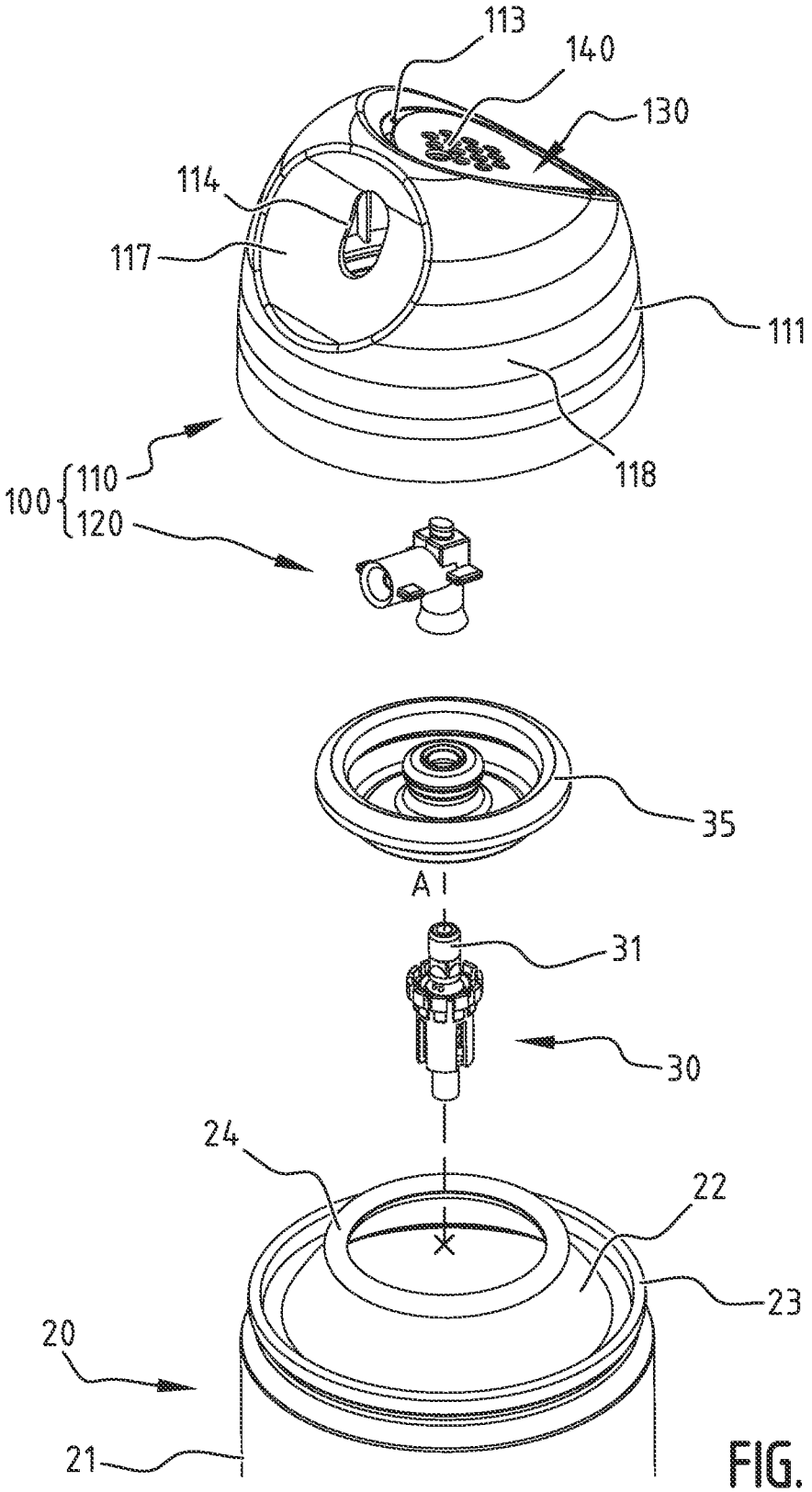
FIGS. 1A and 1B show an exploded perspective view and a longitudinal cross-sectional perspective view, respectively, of the diffuser, the pressurized container's valve, and the pressurized container according to an embodiment of the invention.
Figure 1B:
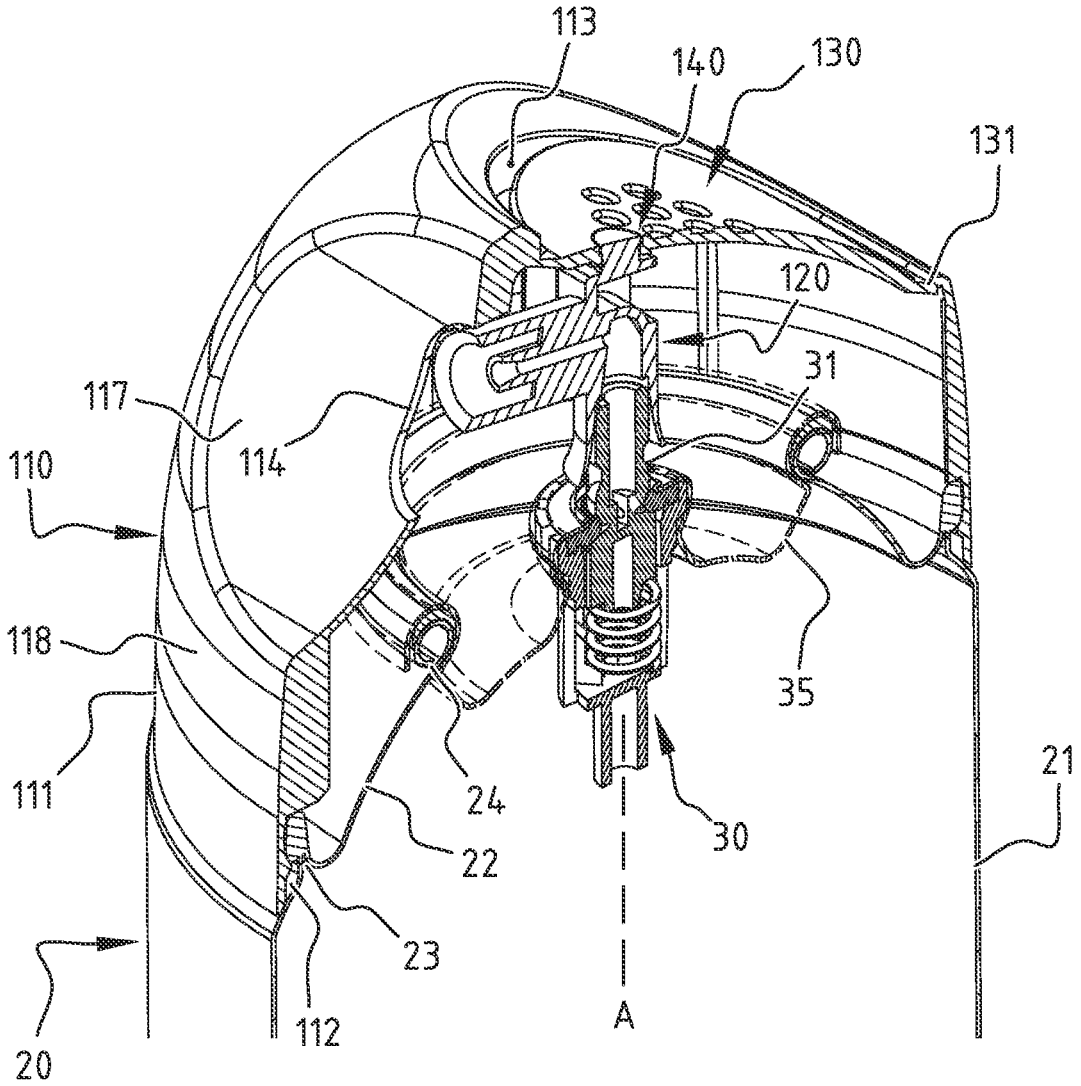

FIGS. 1A and 1B show an exploded perspective view and a longitudinal cross-sectional perspective view, respectively, of the diffuser, the pressurized container's valve, and the pressurized container according to an exemplary embodiment of the invention.

The invention relates to a diffuser 100 for a pressurized container 20, especially for an aerosol generator, a foam generator, a dispenser system for gel, cream or other paste or liquid products, etc. The diffuser 100 is used to actuate the valve 30 of the container in order to remove some of the contents from the pressurized container 20 and to dispense it in the form of an aerosol or foam, for example. Pressurized containers 20 are generally made of a casing 21 fitted with a neck closed with a valve 30 mounted on a valve cup 35. Sometimes the valve cup 35 is attached to the casing 21 by way of a dome 22. When the valve 30 is male type, a flow restrictor 31 or stem protrudes from the valve 30.

The diffuser 100 comprises a base body 110 and an outlet duct 120. The base body 110 may have a cavity formed by an outer wall 111 of the base body 110 or provided in a substantially solid body. The outlet duct 120 can be fully or partially housed within the cavity formed by the outer wall 111. The outer wall 111 can comprise concave and/or convex parts. Thus, the base body 110 may form a cavity which may comprise a concave wall 118 and a convex wall 117 forming a recess in the cavity. In the context of the invention, the adjectives "concave" and "convex" refer to the inside of the base body 110. In other words, these adjectives refer to an observer situated in the cavity of the base body 110.

Pressurized containers 20 generally have a cylindrical end on which the base body 110 will be fixed. The flow restrictor 31 of the valve 30 protrudes from this end and is centred in relation to this end. The flow restrictor 31, the main body of the valve 30, and the cylindrical end of the pressurized container 20 are aligned along an axis A. In order to cooperate with the container's cylindrical end, a lower part of the outer wall 111 of the base body 110 may exhibit rotational symmetry around axis A when attached to the container 20.

Figure 2A:
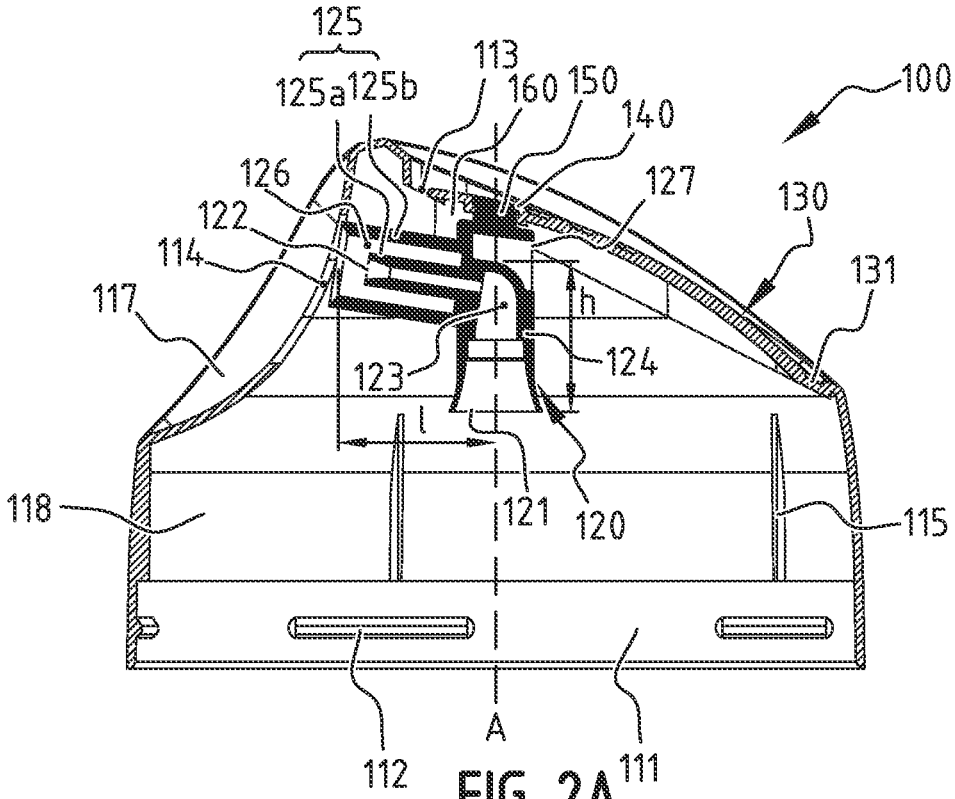
FIGS. 2A and 2B show a longitudinal cross-sectional view of the diffuser and an enlargement, respectively, according to the embodiment in FIGS. 1A and 1B.

The base body 110 may be fitted with a fastening ring 112 which allows it to be fastened either directly to the pressurized container 20, particularly on the casing 21 or the valve 30, or by means of a collar. This fastening ring 112 may be fitted with fastening means arranged continuously or at regular intervals along the periphery of the fastening ring. These fastening means may be intended to cooperate with complementary fastening means created on the casing 21 or the valve 30 of the pressurized container 20, or on the collar 23. In particular, the series of gadroons 112 regularly distributed as shown in FIG. 1B or 2A may snap behind a rolled edge 24 at the interface between the casing 21 and and the valve cup 35 or between the casing 21 and the dome 22 on which the valve cup 35 is fastened. Other fastening means may be considered, such as a continuous rib, a thread for a screw connection, increased thickness of material for welding, glue for bonding, etc.

The base body wall 111 may have a finger tab opening 113 in which the finger tab 130 sits. The finger tab 130 may be attached to the rest of the base body 110 by a tongue 131 which serves as a hinge such that when pressure is exerted on the finger tab 130 towards the inside of the base body 110, thus towards the valve 30 when the diffuser 100 is fastened on the pressurized container 20, the finger tab 130 pivots around an axis which passes transversally through the tongue 131. In the example in FIGS. 1A and 1B, the finger tab 130 and the corresponding finger tab opening 113 are situated near the top of the base body 110. In other embodiments, the finger tab 130 may be separate from the base body 110 and be depressed either in a vertical translational motion or in a rocking motion around a support.

An outlet opening 114 may be created in the wall 111 of the base body 110. The outlet opening 114 may be configured so that the product withdrawn from the pressurized container through it when being released from the outlet duct 120. The adjectives "front" and "rear" refer to this release of the product through the outlet opening 114, the product being released through a front section of the diffuser 100 with the rear section being opposite to it. In the example of FIGS. 1A and 1B, the finger tab 130 is fastened to the rest of the base body 110 by the tongue 131 situated to the rear of the finger tab 130. In another exemplary embodiment, the finger tab may be fastened by the tongue situated to the front of the finger tab, see FIG. 4.

The base body 110 may include a connecting hole 140. The connecting hole 140 may be a through hole between an outer surface of the base body 110 and an inner surface of the base body 110, and may be configured to facilitate the attachment of the outlet duct 120 in such a way that the outlet duct 120 may be fastened to the base body 110. The outlet duct 120 may be fastened to the base body 110 by joining them mechanically, by bonding, welding, and/or heat-bonding. In the example in FIGS. 1A and 1B, the connecting hole 140 is located in the longitudinal cross-section plane of the base body 110, on a front part of the finger tab 130.

In the embodiment of FIGS. 1A and 1B, the material used for the outlet duct 120 is a material different from the material used for the base body 110. In other words, the material used for the outlet duct 120 and the material used for the part of the base body 110 are of different compositions. The term "composition" is intended to mean "chemical composition" in the context of the invention. For example, due to the possible presence of impurities in the recycled material, as aforementioned, the recycled material used for the part of the base body 110 is of a different composition from that of the material used for the outlet duct 120.

The material used for the part of the base body 110 may have a total rate of constituent migration from said material into a reference product that is greater than the total rate of constituent migration from the material used for the outlet duct 120 into the reference product. For example, the total rate of constituent migration from the material used for the outlet duct 120 into the reference product may be less than 10 mg of said constituents per 1 $dm^2$ of surface area of said material. A total migration limit de 60 mg/kg may apply to all materials of the outlet duct 120 that are in contact with food products.

The material used for the outlet duct 120 may be an inert material towards the product contained in the pressurized container 20. In the context of the invention, the adjective "inert" refers to a material of the outlet duct 120 with a total rate of constituent migration into the reference product or into the product contained in the pressurized container 20 which is no greater than a certain safety limit, for example greater than the aforementioned total migration limit of 60 mg/kg. In other words, this represents a material for the outlet duct 120 that will not negatively affect, or only in a negligible way, the chemical composition of the product, and therefore its quality.

The material used for the outlet duct 120 may be a virgin material. In the context of the invention, the adjective "virgin" refers to a material that has not yet been used. Thus, the outlet duct 120 may be a first-use outlet duct. For example, the material used for the outlet duct 120 may be a first-use material.

The material used for the outlet duct 120 may be a material suitable for food contact. In the context of the invention, the phrase "suitable for food contact" refers to a material which does not negatively affect the nutritional quality of a food product contained in the pressurized container 20, thus ensuring that it is safe for consumption.

The material used for the outlet duct 120 may comprise any one of the following materials: a polymeric material, a metal, or a combination of said aforementioned materials. The polymeric material may comprise any one of the following polymers: polyethylene (PE), polypropylene (PP), polyoxymethylene (POM), butylene polyterephthalate (PBT), polyamide (PA), or a combination of said aforementioned polymers. According to another exemplary embodiment, the metal may comprise aluminium, steel, especially stainless steel, or an alloy of two aforementioned metals.

The material used for the part of the base body 110 does not need to satisfy this condition, but may be selected for its mechanical properties or its environmental and/or economic value. For example, if the diffuser 100 is to be used for a food product, the material used for the outlet duct 120 may be suitable for food contact, whilst this is not required of the part of the base body 110, as it is not in contact with the product. According to other examples, the diffuser 100 may be intended for a cosmetic, medical or household product. The material used for the outlet duct 120 may be inert, whilst this is not required of the recycled material used for the part of the base body 110, as it is not in contact with the product.

The material used for the part of the base body 110 is a recycled material. In the context of the invention, the adjective "recycled", as opposed to the adjective "virgin", refers to a material from a used object which is recovered and reintroduced into a production cycle from which it originated.

In other words, the recycled base body 110 is a waste product resulting from previous use and subjected to a recycling process so as to be reintroduced into a production cycle from which it originated. The recycling process in question may comprise physical and/or chemical steps or processes with a view to restoring the ability of the base body 110 to be reintroduced onto the consumption market. In other words, recycling a used object is a treatment process of this object's materials through which materials of a similar or non-similar object having reached the end of its life, or residual manufacturing materials, may be reintroduced into the production cycle of the base body 110. Depending on the quality of the recycling process, impurities may remain within the recycled material.

The material used for the part of the base body 110 may comprise any one of the following materials: a polymeric material, a non-polymeric material, or a combination of said aforementioned materials. The polymeric material may comprise any one of the following polymers: polyethylene (PE), polypropylene (PP), polylactic acid (PLA), polyhydroxyalkanoate (PHA), polybutylene succinate (PBS), or a combination of said aforementioned polymers.

Depending on the fastening means used for attaching the outlet duct 120 to the base body 110, the material used for the base body 110 and the material used for the outlet duct 120 may be chosen to be mechanically and/or chemically compatible with each other or not (see FIGS. 2A-5).

In the context of the invention, the phrase "chemically compatible" refers to a material whose chemical properties, especially chemical reactivity, are compatible with the chemical properties, especially chemical reactivity, of another material, that is to say whose chemical properties do not negatively affect the chemical properties of that other material.

In the context of the invention, the phrase "mechanically compatible" refers to a material whose physical properties, especially mechanical ones, are compatible with the physical properties, especially mechanical ones, of another material, that is to say whose physical properties do not negatively affect the physical properties of that other material.

Thus, a recycled polymeric material of the base body 110 may be mechanically and/or chemically compatible with a polymeric material or a metal of the outlet duct 120. For example, recycled polypropylene (PP) used for manufacturing at least a part of the base body 110 may be mechanically and/or chemically compatible with polyethylene (PE), polypropylene (PP) or aluminium used for manufacturing the outlet duct 120. Similarly, a non-recycled polymeric material of the base body 110 may be mechanically and/or chemically compatible with a polymeric material or a metal of the outlet duct 120. For example, a recycled polymeric material used for manufacturing at least a part of the base body 110 may be mechanically and/or chemically compatible with polyoxymethylene (POM), butylene polyterephthalate (PBT) or (stainless) steel used for manufacturing the outlet duct 120.

It is to be noted that at least a part of the base body 110 is manufactured from recycled material. According to the embodiment of FIGS. 1A and 1B, the entire base body 110 is manufactured from the recycled material. Thus, the finger tab 130, the convex wall 117 and the concave wall 118 of the base body 110 are all made from recycled material. According to another exemplary embodiment, only said part may be manufactured from the recycled material. According to a first example, the finger tab 130 may be made from recycled material. According to a second example, the convex wall 117 may be made from recycled material. According to a third example, the concave wall may be made from recycled material.

A more detailed description of the outlet duct 120, of its positioning in relation to the base body 110 and the way it is fastened to the base body 110 can be read below with reference to FIGS. 2A and 2B.

Figure 2B:
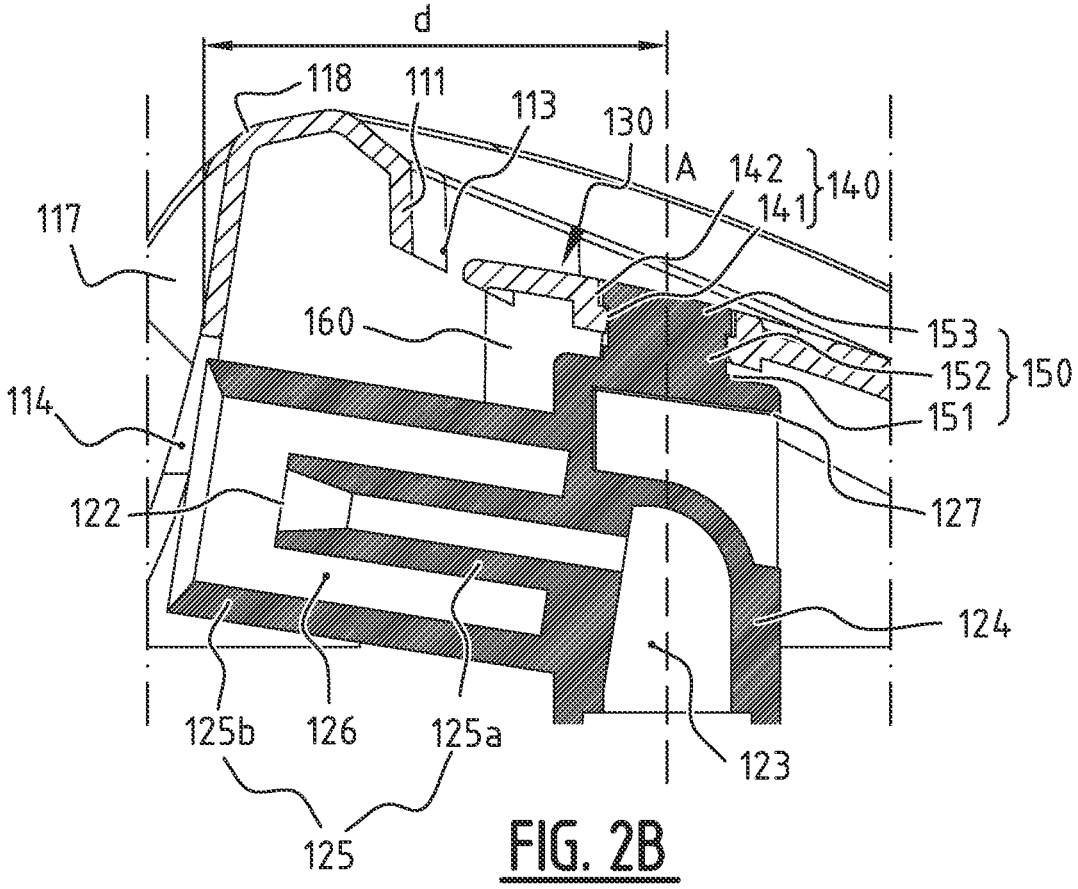

FIGS. 2A and 2B respectively show a longitudinal cross-sectional view of the diffuser and an enlargement, relating to the exemplary embodiment of FIGS. 1A and 1B. At least a part of the base body 110 of the diffuser 100 is manufactured from recycled material. The outlet duct 120 of the diffuser 100 is however manufactured from a material different from the recycled material.

The outlet duct 120 placed in the base body 110 has a passage 123 between a first end 121 and a second end 122. The first end 121 is configured to cooperate with the pressurized container's valve. The second end 122 is configured for the release of the product contained in the pressurized container. When the outlet duct 120 is fastened to the base body 110, the second end 122 is oriented so as to correspond with the outlet opening 114. The second end 122 can be either fixed or floating in relation to the outlet opening 114, and is shown as floating in this example.

The outlet duct 120 has, at its first end 121, means to actuate the valve. If the valve is of female type, the first end 121 may comprise a rod intended to penetrate the valve to actuate it. If the valve is of male type, the first end 121 may be splayed to facilitate the introduction of the stem when mounting the diffuser 100 on the pressurized container.

The second end 122 of the outlet duct opens outwards and may be provided with a nozzle to improve the aerosol quality. If the product is not released in alignment with the valve, the outlet duct 120 may be divided between at least one substantially straight first section 124 and a second section 125 which is at an angle to the first. In this example, the first section 124 starts at the first end 121 and ends at the junction with the second section 125. The second section 125 starts at the junction with the first section 124 and ends at the second end 122. The at least one first section 124 and the second section 125 form the passage 123 between the first end 121 and the second end 122.

In order for a nozzle to be fitted, the second section 125 may have—towards the second end 122—a nozzle housing 126. In the example of FIGS. 2A and 2B, the second section 125 consists of an inner duct 125*a* which forms a portion of the passage 123 and which is surrounded by a cylindrical wall 125*b* towards the second end 122. The annular space between the inner duct 125*a* and the cylindrical wall 125*b* forms the nozzle housing 126. If the diffuser 100 does not have a nozzle, the cylindrical wall 125*b* may not be needed.

To attach the outlet duct 120 to the base body 110, the outlet duct 120 may include a fastening portion 150. In the example of FIGS. 2A and 2B, the fastening portion 150 is joined to the top of the first section 124 of the outlet duct and, when the outlet duct 120 is fastened to the base body 110, extends towards the front of the finger tab 130, coaxially to axis A. According to another embodiment, the fastening portion 150 may extend at a distance from and parallel to axis A. According to yet another embodiment, the fastening portion 150 may extend obliquely in relation to axis A.

To fasten the outlet duct 120 to the base body 110 in the embodiment of FIGS. 2A and 2B, the fastening portion 150 has a part configured to cooperate with a complementary part created in the finger tab 130. The fastening portion 150 is intended to be snapped into the connecting hole 140 to mechanically join the outlet duct 120 to the base body 110.

The fastening portion 150 may include a fastening lug consisting of a substantially cylindrical rod 152 which may be attached by its first end to the outlet duct 120, and which has, at its second end, a cap 153 which has a larger cross-section than the rod 152.

The junction between the rod 152 and the rest of the outlet duct 120 may constitute a shoulder 151 at a distance from the cap 153. In this case, the fastening lug 151, 152, 153, comprises a cylinder in which an annular groove is made. The top of the cylinder corresponds to the cap 153. The annular groove forms the rod 152. The part of the cylinder opposite the cap 153 corresponds to the shoulder 151. The fastening portion 150 may be joined to the outlet duct 120 by a hollow compartment 127. In this example, the hollow compartment 127 has a parallelepiped shape so as to be simple and structurally rigid. The hollow compartment 127 can act as the shoulder 151.

To prevent the outlet duct 120 from pivoting around the fastening portion 150, which would risk the second end 122 of the outlet duct no longer being aligned with the outlet opening 114, anti-rotation means may be provided. In this example, the anti-rotation means consist of two guide tabs 160. These guide tabs 160 are situated on the inner surface of the wall 111 of the base body and extend on both sides of the second section 125 of the outlet duct from the inner surface of the finger tab and in the direction of the first end 121 of the outlet duct. The two guide tabs 160 are placed opposite each other preferably symmetrically in relation to the longitudinal plane parallel to axis A and passing through the centre of the connecting hole 140 and of the outlet opening 114. They can be spaced apart so as to enclose, or at least to fit closely around, the outlet duct 120. To facilitate the installation of the outlet duct 120, the distance between the two guide tabs 160 may widen slightly towards the first end 121 of the outlet duct, along axis A.

In another preferred embodiment, the fastening lug 151, 152, 153 may comprise an asymmetrical or polyhedral cross-section. The connecting hole 140 may comprise an asymmetrical or polyhedral cross-section corresponding to the asymmetrical or polyhedral cross-section of the fastening lug 151, 152, 153. The asymmetrical or polyhedral cross-sections of the fastening lug 151, 152, 153 and the connecting hole 140 can be selected such that, in a fastened state, any rotation of the outlet duct 120 in relation to the base body 110 is prevented.

Depending on the length of the second section 125 of the outlet duct, it can be arranged that the outlet opening 114 be brought closer to axis A, with a front portion comprising the outlet opening 114 being formed by a convex surface 117. As a result of the outlet opening 114 in the convex surface 117 being brought closer, the longitudinal dimension 1 between axis A and the end of the second section 125 may be made less than 15 mm, preferably less than 12.5 mm and even more preferably less than 10 mm. In order to make the outlet duct 120 even more compact, the height h of the first section 124 along axis A between the first end 121 and the top of the passage 123 may be made less than 15 mm, preferably less than 12.5 mm and even more preferably less than 10 mm.

The connecting hole 140 may be made in the base body 110 to facilitate the fastening of the outlet duct 120 to the base body. In this example, the connecting hole 140 is located on the front half of the finger tab 130 and is a through hole between an inner surface and an outer surface of the finger tab 130. The minimum distance d between a first point, said first point being a point of the connecting hole 140 on the outer surface of the finger tab 130, and a second point, said second point being a point of the outlet opening 114 on the outer surface of the base body, may be less than 12 mm, preferably less than 10 mm and even more preferably less than 8 mm.

The above constraints imposed to dimensions 1, h and d of the outlet duct 120 tend to add an additional constraint to the design of the base body 110 which ensures the outlet duct 120 used has reduced dimensions, and thus the amount of material used is economically advantageous. Indeed, since the outlet duct 120 may be manufactured from an inert material and/or a virgin material and/or a material suitable for food contact, production costs for the outlet duct 120 are greater than for the base body 110, since the latter is manufactured from a recycled material. Moreover, due to the presence of said convex wall 117, the outlet opening 114 created in the convex wall 117 may be brought closer to axis A of the valve, and the longitudinal dimension of the outlet duct 120 may be minimized, which contributes to using a lesser amount of inert material and/or virgin material and/or material suitable for food contact.

The connecting hole 140 may be configured to receive and hold the fastening lug 151, 152, 153. The connecting hole 140 may be defined by a first portion 141 and a second portion 142. The first portion 141 may be an internal portion leading to an inner surface of the base body 110, on the inner surface of the finger tab 130 in FIGS. 2A and 2B. The second portion 142 may be an external portion leading to the outer surface of the base body 110, on the outer surface of the finger tab 130 in FIGS. 2A and 2B.

The first portion 141 of the connecting hole may have dimensions suitable to accommodate the fastening lug's rod 152. The second portion 142 of the connecting hole may be broader and have dimensions to accommodate the fastening lug's cap 153. Additionally, the second portion 142 and the cap 153 may be configured so that the surface of the end of the cap 153 is flush with the outer surface of the base body 110, and flush with the outer surface of the finger tab 130 in FIGS. 2A and 2B. Thus, in this example, the surface of the end of the cap 153 is not perpendicular to the axis of the rod 151, but slightly tilted to follow the contour of the outer surface of the finger tab 130 around the connecting hole 140.

In another preferred embodiment, the cap 153 may protrude beyond or be recessed from the outer surface of the finger tab 130 around the connecting hole 140. Alternatively or additionally, the cap 153 and the connecting hole 140 may have cross-sections with different shapes and the cap 153 may be inserted through the connecting hole by pivoting the outlet duct 120 with respect to its final position in a fastened state.

When being attached, the outlet duct 120 may be inserted into the cavity formed by the outer wall 111 of the base body. The second end 122 of the outlet duct may be oriented towards the outlet opening 114. The fastening portion 150 is inserted into the connecting hole 140. The cap 153 of the fastening lug may be forcibly pushed through the connecting hole 140. In this example, the cap 153 passes forcibly through the first portion 141 of the connecting hole until it reaches the second portion 142 whose cross-section is sufficient to accommodate it. In this position, the rod 152 of the fastening lug is positioned in the first portion 141 of the connecting hole, and the shoulder 151 is located close to, or in contact with, the inner surface of the finger tab 130.

At the same time, the second section 125 of the outlet duct 120 may be inserted between the guide tabs 160. The guide tabs 160 can thus guide the outlet duct so that the second end 122 of the outlet duct and the base body's outlet opening 114 correspond. The fastening lug 151, 152, 153 attached through the connecting hole 140 may prevent the translation of the outlet duct 120 in relation to the finger tab 130 along axis A. The guide tabs 160 may prevent the rotation of the outlet duct 120 in relation to the base body 110 around axis A.

In another preferred embodiment, the outer surface of the finger tab 130 has reliefs to give better friction with a user's finger. The size and/or shape of the fastening lug's cap 153 may be such as to form part of these reliefs. For example, reliefs are formed by indentations on the outer surface of the finger tab, and the dimensions of the cap 153 are such that it cooperates with the connecting hole 140 to form a substantially similar indentation.

Additionally, a portion of the fastening lug 151, 152, 153, in a fastened state, may be visible from the outside of the diffuser 100, and may have a distinctive shape and/or colour which serve as a means of identification for the user. In this manner, the fastening lug 151, 152, 153 may have the dual function of identification and fastening means. The shape and/or colour of the fastening lug may indicate the type of product, the origin of the product, usage precautions of the product, a conditioning of the product, etc.

Depending on the type of mechanical fastening means used for attaching the outlet duct 120 to base body 110 in the embodiment of FIGS. 2A and 2B, the material used for the base body 110 and the material used for the outlet duct 120 may be chosen to be mechanically compatible with each other, but not necessarily chemically compatible. More particularly, in the embodiment of FIGS. 2A and 2B, the fastening portion 150 is made from a material that is mechanically compatible, but not necessarily chemically compatible, with the recycled material of the finger tab 130 where the connecting hole 140 is created. For example, a recycled polymeric material of the finger tab 130 may be mechanically and/or chemically compatible with a polymeric material of the fastening portion 150. According to the embodiment of FIGS. 2A and 2B, the entire base body 110 is manufactured from the recycled material. Thus, the finger tab 130, the convex wall 117 and the concave wall 118 of the base body 110 are all made from recycled material.

Figure 3:
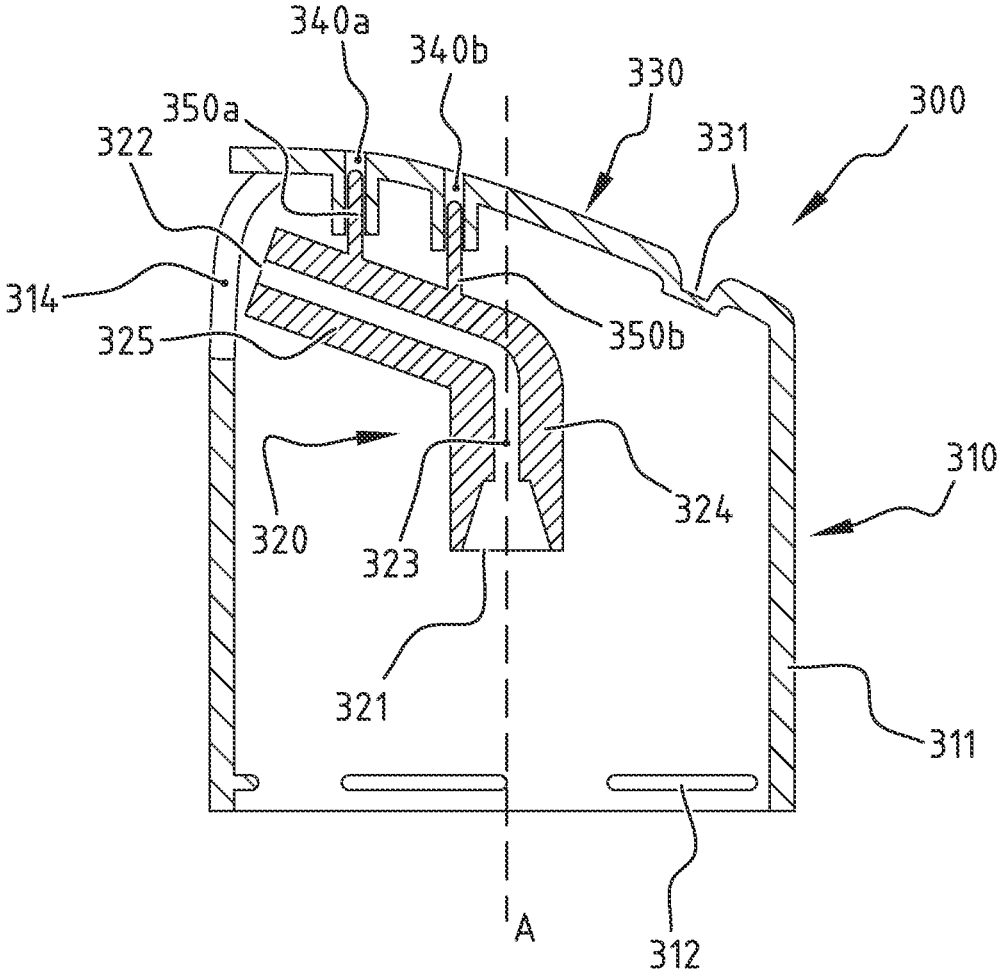
FIG. 3 shows a longitudinal cross-sectional view of the diffuser according to another embodiment of the invention.

FIG. 3 shows a longitudinal cross-sectional view of the diffuser according to another exemplary embodiment of the invention. The diffuser 300 comprises a base body 310 and an outlet duct 320.

At least a part of the base body 310 is manufactured from recycled material. The outlet duct 320 is however manufactured from a material different from the recycled material.

The base body 310 may include an outer wall 311. The outer wall 311 may form a cavity, and the outlet duct 320 may be fully or partially housed in the cavity formed by the outer wall 311, shown as fully housed in this example. The outer wall 311 may comprise concave and/or convex parts.

The diffuser 300 is a diffuser for a pressurized container. The pressurized container may include a cylindrical end. In order to cooperate with the cylindrical end of the container, a lower part of the outer wall 311 of the base body may have rotational symmetry around axis A when attached to the container. The base body 310 may be configured to be attached to the pressurized container by means of a fastening ring 312. In this example, the fastening ring 312 has a series of gadroons regularly distributed along the periphery of an inner surface of the base body's outer wall 311. The fastening ring 312 may be adapted to snap behind a rolled edge of the upper end of the pressurized container.

The base body 310 may include a finger tab 330 to be depressed by the user in order to actuate the pressurized container's valve. The base body's outer wall 311 may be pierced with a finger tab opening in which the finger tab 330 sits. The finger tab 330 may be attached to the rest of the base body 310 by a tongue 331 behind the finger tab 330 which serves as a hinge such that the finger tab 330 pivots around an axis which passes transversally through the tongue 331.

An outlet opening 314 may be created in the outer wall 311 of the base body. The outlet opening 314 may be configured so that the product withdrawn from the pressurized container passes through it when being released from the outlet duct 320. In the embodiment of FIG. 3, the finger tab opening is joined to the outlet opening 314 at the front of the base body 310. In another embodiment, an arch may separate the outlet opening from the finger tab opening so that the structural strength of the top of the base body 310 is reinforced.

The base body 310 includes a connecting hole 340*a*, 340*b*. In this example, the finger tab 330 is provided with two connecting holes 340*a*, 340*b*. The two connecting holes 340*a*, 340*b* may be located towards the front of the finger tab 330 in the diffuser's longitudinal plane passing through axis A. The two connecting holes 340*a*, 340*b* may be through holes between an outer surface of the finger tab 330 and an inner surface of the finger tab 330 and may extend substantially parallel to axis A. The connecting holes 340*a*, 340*b* may be defined by a cylindrical wall which extends away from an inner surface of the finger tab 330 in a direction substantially parallel to axis A. A person skilled in the art will understand that multiple variations of connecting holes 340*a*, 340*b* may be achieved by varying, for example, the number, dimensions, positioning or profile of the connecting holes.

The connecting holes 340*a*, 340*b* can be configured to cooperate with a portion of the outlet duct 320. In this example, the outlet duct 320 may comprise two fastening portions 350*a*, 350*b* to be introduced into the corresponding connecting holes 340, 340*b* so that the outlet duct 320 is fastened to the base body. The outlet duct 320 may be held by the two fastening portions 350*a*, 350*b*, introduced in the corresponding connecting holes 340*a*, 340*b* by interlocking, bonding, heat-bonding, welding, etc.

The outlet duct 320 placed in the base body 310 has a passage 323 between a first end 321 and a second end 322. The first end 321 is configured to cooperate with the pressurized container's valve. The second end 322 is configured for the release of the product contained in the pressurized container. When the outlet duct 320 is fastened to the base body 310, the second end 322 is oriented so as to correspond with the outlet opening 314. The second end 322 may be floating in relation to the outlet opening 314. The outlet duct 320 may be divided between a substantially straight first section 324 and a second section 325 which is at an angle to the first. The first section 324 may start at the first end 321 and end at the junction with the second section 325. The second section 325 may start at the junction with the first section 324 and end at the second end 322. The first section 324 and the second section 325 may form the passage 323 between the first end 321 and the second end 322.

The two fastening portions 350*a*, 350*b* of the outlet duct 320 may extend away from the second section 325 of the outlet duct, in a manner substantially parallel to axis A, towards the finger tab 330. When being attached, the outlet duct 320 may be inserted into the cavity formed by the wall 311 of the base body. The second end 322 of the outlet duct may be oriented towards the outlet opening 314. The fastening portions 350*a*, 350*b* for connecting the outlet duct 320 to the base body may be inserted in the corresponding connecting holes 340*a*, 340*b* before being attached to said holes by bonding, interlocking, heat-bonding or welding. As a result of the two connecting holes 340*a*, 340*b* cooperating with the two fastening portions 350*a*, 350*b* of the outlet duct, the rotation of the outlet duct 320 in relation to the base body 310 can be prevented. A person skilled in the art will understand that alternatively this rotation can be prevented by modifying the number and/or the shape of the inserted portions and of the corresponding connecting holes.

Depending on the fastening means used for attaching the outlet duct 320 to the base body 310, the material used for the base body 310 and the material used for the outlet duct 320 may be chosen to be mechanically and/or chemically compatible with each other or not. More particularly, in the embodiment of FIG. 3 both fastening portions 350*a*, 350*b* are made from a material which may be mechanically and/or chemically compatible with the recycled material of the finger tab 330 where the connecting holes 340*a*, 340*b* are created. For example, a recycled polymeric material of the finger tab 330 may be mechanically and/or chemically compatible with a polymeric material of the fastening portions 350*a*, 350*b*. According to the embodiment of FIG. 3, the entire base body 310 is manufactured from the recycled material. Thus, the finger tab 330 and the outer wall 311 of the base body 310 are both made from the recycled material.

Figure 4:
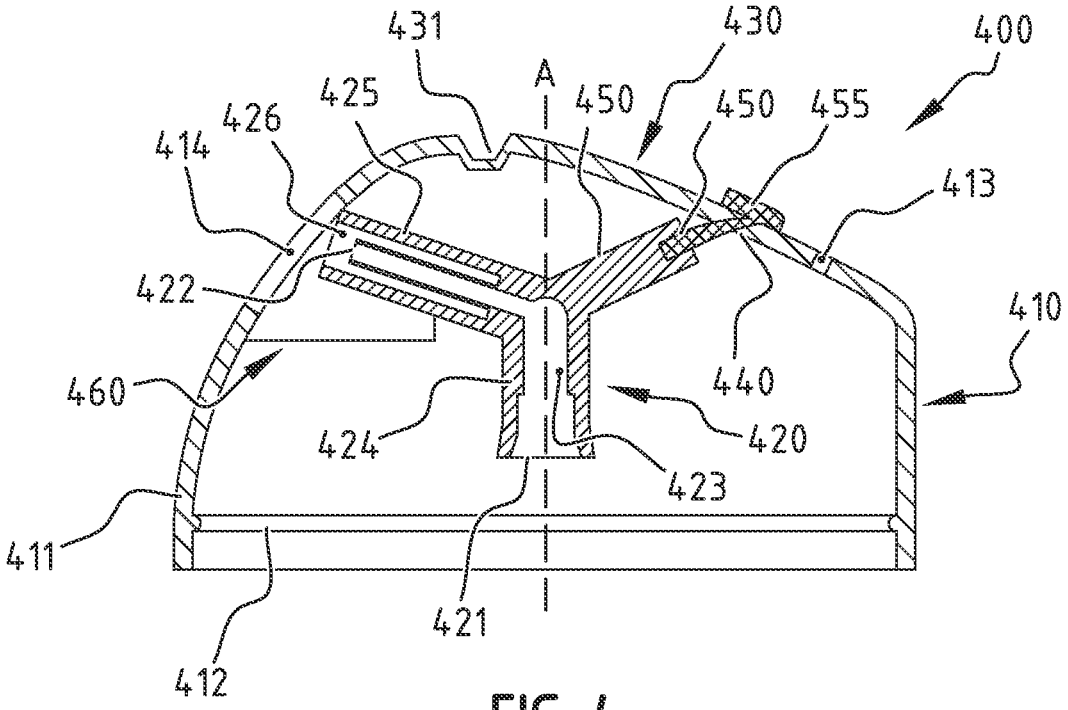
FIG. 4 shows a longitudinal cross-sectional view of the diffuser according to another embodiment of the invention.

FIG. 4 shows a longitudinal cross-sectional view of the diffuser according to another exemplary embodiment of the invention. The diffuser 400 comprises a base body 410 and an outlet duct 420. At least a part of the base body 410 is manufactured from recycled material. The outlet duct 420 is however manufactured from a material different from the recycled material.

The base body 410 may include an outer wall 411. The outer wall 411 may include concave sections forming a cavity, and the outlet duct 420 may be fully housed in the cavity formed by the outer wall 411. In order to cooperate with a cylindrical end of a pressurized container fitted with a valve, a lower part of the outer wall 411 of the base body may exhibit rotational symmetry around an axis A when attached to the container. The base body 410 may be configured to be attached to the pressurized container by means of a fastening ring 412. In this example, the fastening ring 412 is fitted with a continuous rib on the periphery of an inner surface of the outer wall 411 of the base body in such a way that the continuous rib can snap behind a rolled edge of the upper end of the pressurized container.

The base body 410 may include a finger tab 430 to be depressed by the user, said finger tab 430 being formed by a finger tab opening 413 in the outer wall 411 of the base body. The finger tab 430 may be attached to the rest of the base body 410 by a tongue 431 at the front of the finger tab 430 which serves as a hinge.

An outlet opening 414 may be created in the outer wall 411 of the base body. The outlet opening 414 may be configured so that the product withdrawn from the pressurized container passes through it when being released from the outlet duct 420.

The base body 410 includes a connecting hole 440. In this example, the finger tab 430 is provided with one connecting hole 440. The connecting hole 440 may be located towards the back of the finger tab 430 in the diffuser's longitudinal plane passing through axis A. The connecting hole 440 may be a through hole between an outer surface and an inner surface of the finger tab 430 and extend substantially towards the centre of the base body 410. The connecting hole 440 may be configured to facilitate the attachment of the outlet duct 420 to the base body 410.

The outlet duct 420 placed in the base body 410 has a passage 423 between a first end 421 and a second end 422. The first end 421 is configured to cooperate with the pressurized container's valve. The second end 422 is configured for the release of the product contained in the pressurized container. When the outlet duct 420 is fastened to the base body 410, the second end 422 is oriented so as to correspond with the outlet opening 414. The second end 422 may be floating in relation to the outlet opening 414.

The outlet duct 420 may be divided between a substantially straight first section 424 and a second section 425 which is at an angle to the first. The first section 424 and the second section 425 may create the passage 423 between the first end 421 and the second end 422. In order for a nozzle to be fitted, the second section 425 may be provided—towards the second end 422—with a nozzle housing 426. Said nozzle housing 426 may be formed by an annular space between an inner duct and the surrounding cylindrical wall of the second section 425.

To fasten the outlet duct 420 to the base body 410 in the embodiment of FIG. 4, the outlet duct 420 comprises a fastening portion 450. The fastening portion 450 may be substantially cylindrical and extend towards the back of the finger tab 430, in a fastened state, from the top of first portion 424 of the outlet duct. The fastening portion 450 may have a part which is configured to cooperate with an additional part or element so that the outlet duct 420 is fastened to the base body 410.

The fastening portion 450 may include an attachment hole 451 configured to cooperate with attaching means 455. The attachment hole 451 may be blind or through, threaded or unthreaded. The attaching means 455 may be a screw, a bolt, a rivet, etc. When being attached, the outlet duct 420 may be inserted into the cavity formed by the outer wall 411 of the base body. The second end 422 of the outlet duct may be oriented in the direction of the outlet opening 414. The second section 425 of the outlet duct 420 may be inserted between guide tabs 460. The guide tabs 460 may thus guide the outlet duct 420 so that the second end 422 of the outlet duct and the base body's outlet opening 414 correspond.

These guide tabs 460 may be situated on the inner surface of the outer wall 411 of the base body and extend on both sides of the outlet duct's outlet opening 414, and towards axis A in such a manner as to fit tightly around the second section 425 of the outlet duct. The two guide tabs 460 are located opposite each other preferably symmetrically in relation to the longitudinal plane parallel to axis A and passing through the centre of the connecting hole 440 and the outlet opening 414.

The attachment hole 451 may be aligned with the connecting hole 440. In this manner the attaching means 455 may be inserted through the connecting hole 440 to cooperate with the attachment hole 451 and fasten the outlet duct 420 to the base body 410. The connecting hole 440 may be configured such that, in a fastened state, the attaching means 455 is flush with the outer surface of the finger tab 430 around the connecting hole 440.

Depending on the type of mechanical fastening means used for attaching the outlet duct 320 to the base body 310 in the embodiment of FIG. 4, the material used for the base body 310 and the material used for the outlet duct 320 may be chosen to be mechanically compatible with each other, but not necessarily chemically compatible. More particularly, in the embodiment of FIG. 4, the fastening portion 450 is made from a material which may be mechanically and/or chemically compatible with the material—whether recycled or not—of the fastening means 455. For example, a recycled metal of the fastening means 455 may be mechanically and/or chemically compatible with a metal of the fastening portion 450. According to the embodiment of FIG. 4, the entire base body 410 is manufactured from the recycled material. Thus, the finger tab 430 and the outer wall 411 of the base body 410 are both made from the recycled material.

Figure 5:
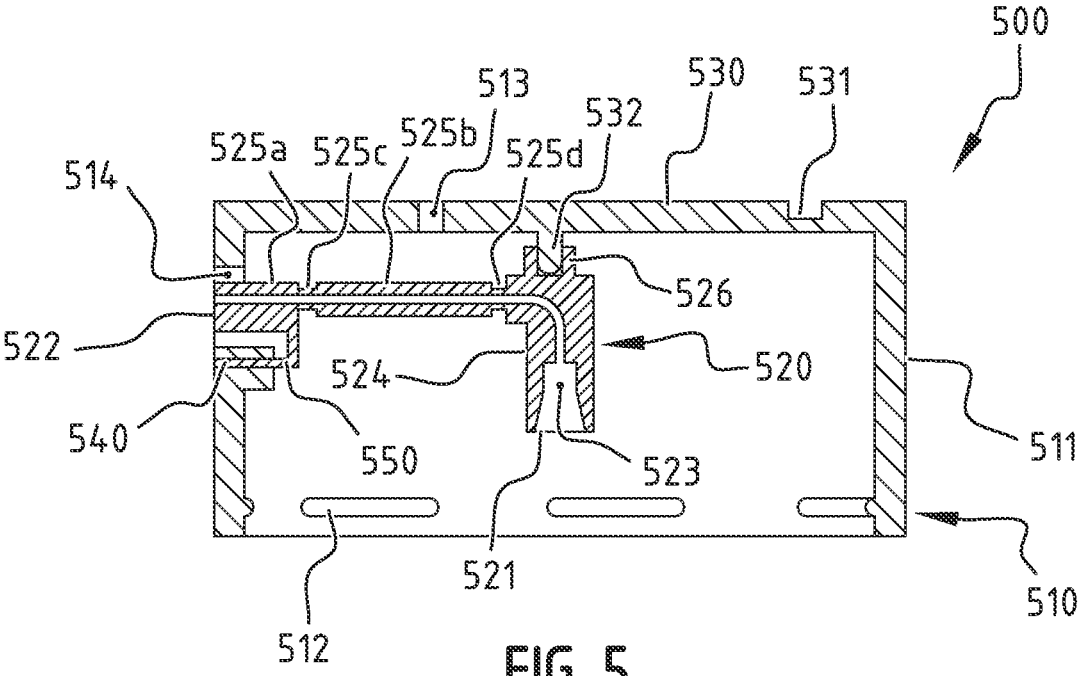
FIG. 5 shows a longitudinal cross-sectional view of the diffuser according to another embodiment of the invention.

FIG. 5 shows a longitudinal cross-sectional view of the diffuser according to another exemplary embodiment of the invention. The diffuser 500 comprises a base body 510 and an outlet duct 520. At least a part of the base body 510 is manufactured from recycled material. The outlet duct 520 is however manufactured from a material different from the recycled material.

The base body 510 may include an outer wall 511. The outer wall 511 may include concave parts forming a cavity, and the outlet duct 520 may be fully housed in the cavity formed by the outer wall 511. In this example, the outer wall 511 is substantially cylindrical. In order to cooperate with a cylindrical end of a pressurized container fitted with a valve, a lower part of the outer wall 511 of the base body may exhibit rotational symmetry around an axis A when attached to the container. The base body 510 may be configured to be attached to the pressurized container by means of a fastening ring 512. In this example, the fastening ring 512 is fitted with a series of gadroons regularly distributed along the periphery of an inner surface of the outer wall 511 of the base body in such a way that the series of gadroons can snap behind a rolled edge of the upper end of the pressurized container.

The base body 510 may include a finger tab 530 to be depressed by the user, said finger tab 530 being formed by a finger tab opening 513 in the outer wall 511 of the base body. The finger tab 530 may be attached to the rest of the base body 510 by a tongue 531, at the back of the finger tab 530, which serves as a hinge.

An outlet opening 514 may be created in the outer wall 511 of the base body. The outlet opening 514 may be configured so that the product withdrawn from the pressurized container passes through it when being released from the outlet duct 520.

The base body 510 includes a connecting hole 540. In this example, there is one connecting hole 540 through the outer wall 511 of the base body below the outlet opening 514 at a distance from the outlet opening 514. The connecting hole 540 may be located in the longitudinal plane of the diffuser passing through axis A. The connecting hole 540 be a through hole between an inner surface and an outer surface of the outer wall 511 of the base body and may extend substantially parallel to the axis of the outlet opening 514.

The outlet duct 520 placed in the base body 510 has a passage 523 between a first end 521 and a second end 522. The first end 521 is configured to cooperate with the pressurized container's valve. The second end 522 is configured for the release of the product contained in the pressurized container. When the outlet duct 520 is fastened to the base body 510, the second end 522 is oriented so as to correspond with the outlet opening 514. The second end 522 may have a fixed position in relation to the outlet opening 514.

The outlet duct 520 may be divided between a substantially straight first section 524 and a second section 525*a*, 525*b*, 525*c*, 525*d* which is substantially perpendicular to the first when the finger tab 530 is in a resting position. The first section 524 and the second section 525*a*, 525*b*, 525*c*, 525*d* may form the passage 523 between the first end 521 and the second end 522.

The second section 525*a*, 525*b*, 525*c*, 525*d* may be of an overall cylindrical shape and include, on its outer surface near the junction with the first section 525, a first notch 525*d* defining a first deformable portion of the second section 525*a*, 525*b*, 525*c*, 525*d*. The second section 525*a*, 525*b*, 525*c*, 525*d* may also comprise a second notch 525*c* located near the inner surface of the outer wall 511 of the base body defining a second deformable portion of the second section 525*a*, 525*b*, 525*c*, 525*d*. The first notch 525*d* and the second notch 525*c* may define a moving part 525*b* of the passage 523, said moving part 525*b* being able to move in accordance with the vertical movements of the first section 524. The first section 525*a*, 525*b*, 525*c*, 525*d* may include a part 525*a* which is fixed in relation to the outlet opening 514. Said fixed part 525*a* may be defined between the second notch 525*c* and the second end 522 of the outlet duct.

In order to fasten the outlet duct 520 to the base body 510 in the embodiment of FIG. 5, the outlet duct 520 includes a fastening portion 550. The fastening portion 550 may consist of a plug joined to the fixed part 525*a* of the outlet duct's second section, and extending substantially parallel to it at a distance. The fastening portion 550 can be configured to be inserted into the connecting hole 540 and keep the outlet duct 520 fastened to the base body 510 by interlocking, bonding, heat-bonding, welding, etc. A person skilled in the art will understand that the number, the shape and the dimensions of the plug may be varied depending on the desired fastening. The fastening portion 550, when the outlet duct 520 is fastened to the base body 510, may keep the second end 522 of the outlet duct in a fixed position in relation to the outlet opening. Moreover, the fastening portion 550 may prevent rotation of the outlet duct 520 relative to the base body.

The outlet duct 520 may include an attachment portion 526 to attach the outlet duct 520 to the finger tab 530. The attachment portion 526 may be configured to be attached to a fastening element 532 provided to the finger tab 530. In this example, the fastening element 532 is a plug protruding from the inner surface of the finger tab 530 extending substantially vertically towards the top of the first section 524 of the outlet duct. The attachment portion 526, in FIG. 5, is a cylindrical wall protruding from the top of the outlet duct's first section 524 extending substantially vertically towards the inner surface of the finger tab 530. The attachment portion 526 and the fastening element 532 may be designed to cooperate mechanically and to attach the finger tab 530 to the outlet duct 520 by interlocking, bonding, heat-bonding, or welding.

Preferably, the axes of the fastening element 532, the attachment portion 526, the first section 524 of the outlet duct, and the pressurized container's valve are coaxial. Pressure exerted by the user on the finger tab 530 may cause a substantially vertical displacement of the outlet duct's first section and an actuation of the pressurized container's valve. The vertical displacement of the outlet duct's first section 524 is followed by bending of the deformable sections 525*c*, 525*d* of the second section of the outlet duct 520. When the finger tab is in the actuated position, the moving part 525*b* of the second section may be at an angle to the outlet duct's first section 524. The actuation of the valve causes the product contained in the pressurized container to be released from the outlet duct's second end 522 via the outlet duct's passage 523.

Depending on the fastening means used for attaching the outlet duct 520 to the base body 510, the material used for the base body 510 and the material used for the outlet duct 520 may be chosen to be mechanically and/or chemically compatible with each other or not. More particularly, in the embodiment of FIG. 5, the fastening portion 550 is made from a material which may be mechanically and/or chemically compatible with the recycled material of the base body 510 where the connecting hole 540 is created. For example, a recycled polymeric material of the base body 510 may be mechanically and/or chemically compatible with a polymeric material of the fastening portion 550. According to the embodiment of FIG. 5, the entire base body 510 is manufactured from the recycled material. Thus, the finger tab 530 and the outer wall 511 of the base body 510 are both made from the recycled material.

Although the principles of the invention have been described above with reference to specific embodiments, it should be understood that this description is merely by way of example and should not be construed as a limitation of the scope of the invention which is defined by the accompanying claims.

The invention claimed is:

1. A diffuser for a pressurized container fitted with a valve, especially for an aerosol generator, which diffuser is provided with:

a base body having a finger tab to be depressed by the user to actuate the valve and having an outlet opening for the release of a product contained in the pressurized container; and an outlet duct placed in the base body has a first end configured to cooperate with the valve of the pressurized container and a second end configured for the release of the product contained in the pressurized container;

wherein the outlet duct is coupled to the base body in such a way that the second end of the outlet duct is substantially facing the outlet opening of the base body;

wherein at least a part of the base body is manufactured from recycled material and the outlet duct is manufactured from a material different from the recycled material; and wherein the base body is provided with a connecting hole in the finger tab and the outlet duct includes a fastening portion projecting from the top of the outlet duct through the connecting hole for fastening the outlet duct to the base body.

2. The diffuser for a pressurized container according to claim 1, wherein the material used for the part of the base body has a total rate of constituent migration from said material into a reference product that is greater than the total rate of constituent migration from the material used for the outlet duct into the reference product.

3. The diffuser for a pressurized container according to claim 2, wherein the total rate of migration of the constituents of the material used for the outlet duct into the reference product is less than 10 mg of said constituents per 1 $dm^2$ of surface area of said material.

4. The diffuser for a pressurized container according to claim 1, wherein the material used for the outlet duct is a virgin material.

5. The diffuser for a pressurized container according to claim 1, wherein the material used for the outlet duct is a material suitable for food contact.

6. The diffuser for a pressurized container according to claim 1, wherein the material used for the outlet duct comprises any one of the following materials: a polymeric material, a metal, or a combination of said aforementioned materials.

7. The diffuser for a pressurized container according to claim 6, wherein the polymeric material comprises any of the following polymers: polyethylene, polypropylene, polyoxymethylene, butylene polyterephthalate, polyamide, or a combination of said aforementioned polymers.

8. The diffuser for a pressurized container according to claim 1, wherein the material used for the part of the base body comprises any of the following materials: a polymeric material, a non-polymeric material, or a combination of said aforementioned materials.

9. The diffuser for a pressurized container according to claim 8, wherein the polymeric material comprises one of the following polymers: polyethylene, polypropylene, polylactic acid, polyhydroxyalkanoate, polybutylene succinate, or a combination of said aforementioned polymers.

10. The diffuser for a pressurized container according to claim 1, wherein the entire base body is manufactured from the recycled material.

11. The diffuser for a pressurized container according to claim 1, wherein a minimum longitudinal distance between a first point, said first point being a point of the connecting hole, and a second point, said second point being a point of the outlet opening on an outer surface of the base body, is less than 12 mm.

12. The diffuser for a pressurized container according to claim 1, wherein the second end of the outlet duct is floating in relation to the outlet opening.

13. A base body for use in a diffuser for a pressurized container according to claim 1.

14. An outlet duct for use in a diffuser for a pressurized container according to claim 1.

15. Using a diffuser for a pressurized container according to claim 1 for dispensing a food product, or a cosmetic, pharmaceutical or medical product.

16. The diffuser for a pressurized container according to claim 1, wherein a minimum longitudinal distance between a first point, said first point being a point of the connecting hole, and a second point, said second point being a point of the outlet opening on an outer surface of the base body, is less than 10 mm.

17. The diffuser for a pressurized container according to claim 1, wherein a minimum longitudinal distance between a first point, said first point being a point of the connecting hole, and a second point, said second point being a point of the outlet opening on an outer surface of the base body, is less than 8 mm.

* * * * *